US006843517B2

(12) United States Patent
Graute

(10) Patent No.: US 6,843,517 B2
(45) Date of Patent: Jan. 18, 2005

(54) MANUALLY LOCKABLE MOTOR-VEHICLE POWER LATCH

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 10/157,768

(22) Filed: May 29, 2002

(65) Prior Publication Data

US 2002/0190530 A1 Dec. 19, 2002

(30) Foreign Application Priority Data

Jun. 13, 2001 (DE) ..... 101 28 668

(51) Int. Cl.[7] ..... E05C 3/06

(52) U.S. Cl. ..... 292/216; 292/201; 292/DIG. 23; 292/DIG. 53; 70/427

(58) Field of Search ..... 292/DIG. 45, DIG. 53, 292/216, 201, DIG. 23, DIG. 2, DIG. 12; 70/427, 428, 455

(56) References Cited

U.S. PATENT DOCUMENTS

| | | | | | |
|---|---|---|---|---|---|
| 2,034,570 | A | * | 3/1936 | Flavin | 292/65 |
| 4,052,094 | A | * | 10/1977 | Widen | 292/336.3 |
| 4,202,571 | A | * | 5/1980 | Nishikoori | 292/216 |
| 4,470,626 | A | * | 9/1984 | Gergoe et al. | 292/341.12 |
| 4,756,563 | A | * | 7/1988 | Garwood et al. | 292/216 |
| 4,900,074 | A | * | 2/1990 | Kleefeldt et al. | 292/216 |
| 4,969,673 | A | * | 11/1990 | Portelli et al. | 292/216 |
| 5,092,638 | A | * | 3/1992 | Mizuki | 292/216 |
| 5,537,848 | A | * | 7/1996 | Grzanka et al. | 70/279.1 |
| 5,615,564 | A | * | 4/1997 | Inoue | 70/279.1 |
| 5,738,394 | A | * | 4/1998 | Arabia et al. | 292/216 |
| 5,855,130 | A | * | 1/1999 | Rorabacher et al. | 70/277 |
| 5,893,593 | A | * | 4/1999 | Dowling | 292/336.3 |
| 5,979,951 | A | * | 11/1999 | Shimura | 292/216 |
| 6,045,168 | A | * | 4/2000 | Johnson et al. | 292/216 |
| 6,059,328 | A | * | 5/2000 | Gomi | 292/216 |
| 6,123,371 | A | * | 9/2000 | Fisher | 292/216 |
| 6,199,923 | B1 | * | 3/2001 | Rice et al. | 292/216 |
| 6,338,508 | B1 | * | 1/2002 | Kleefeldt | 292/201 |
| 6,386,600 | B1 | * | 5/2002 | Kalsi | 292/216 |
| 6,416,088 | B1 | * | 7/2002 | Graute | 292/216 |
| 6,428,058 | B1 | * | 8/2002 | Graute | 292/216 |
| 6,517,128 | B2 | * | 2/2003 | Perkins et al. | 292/216 |
| 6,607,222 | B2 | * | 8/2003 | Inoue | 292/216 |

FOREIGN PATENT DOCUMENTS

| | | | | |
|---|---|---|---|---|
| DE | 41 08 561 | | 9/1992 | |
| FR | 0200577 | A2 * | 10/1986 | E05B/47/06 |

* cited by examiner

*Primary Examiner*—Gary Estremsky
*Assistant Examiner*—Carlos Lugo
(74) *Attorney, Agent, or Firm*—Herbert Dubno; Andrew Wilford

(57) ABSTRACT

A motor-vehicle door latch has a lever displaceable between a locked position in which the latch is locked and an unlocked position in which the latch is unlocked and a plate carrying the latch and adapted to be exposed at a door edge. The plate is formed with a throughgoing hole, and the lever has a formation exposed at the hole and engageable through the hole to move the lever from the unlocked to the locked position.

7 Claims, 3 Drawing Sheets

MANUALLY LOCKABLE MOTOR-VEHICLE POWER LATCH

FIELD OF THE INVENTION

The present invention relates to a motor-vehicle door latch. More particularly this invention concerns a power-operated latch that can be manually locked.

BACKGROUND OF THE INVENTION

A standard motor-vehicle door latch is mounted on a door edge and comprises a fork or keeper engageable around a bolt projecting from a door post against which the door edge engages when the door is closed. A pawl can normally hold the fork in a position locked around the bolt to maintain the door closed, and can be pivoted by means of an operating lever away from the fork to release the bolt and allow the door to open. This operating lever can be actuated by an inside door handle, an outside door handle, and in a power-lock system by an electrical actuator.

To lock the door, the operating lever is decoupled from the pawl or prevented from moving. This locking action is in turn controlled by mechanism including a locking lever itself movable between an unlocked position in which the operating lever can act on the pawl and a locked position in which the operating lever is either decoupled or blocked, as described. All standard lockable door latches have such a locking lever movable in this manner.

In older vehicles the doors are all provided with inside locking elements, e.g., buttons or levers, that can be manually operated from inside the vehicle to move the locking lever between its positions. The front doors are normally provided with externally operable key cylinders that allow them to be locked and unlocked from outside also. Thus the car can be locked up manually simply by locking the back doors from inside and the front doors from outside. These inside locking buttons and levers make it relatively easy to break into a car, for instance by slipping a wire through the window seal and hooking it on the button or lever. Thus in recent times these inside locking elements have been eliminated for security's sake.

In a standard central power-lock system the locking lever of each door is moved between its positions by its own actuator. All the actuators are connected to a central controller that is itself operated often by a remote controller carried by the operator of the vehicle. Such a system is extremely convenient in that it allows the vehicle operator to lock and unlock all the doors at one time, normally simply by pushing a button on the driver's door or on the remote.

The central-locking system has, however, the considerable disadvantage that, if the system fails to operate, it becomes on the one hand necessary to lock the front doors manually by means of their key cylinders, and impossible to lock the rear doors which as described above nowadays do not have the inside unlocking buttons or levers.

Accordingly German patent 4,108,561 of Theodor Menke proposes a system where a small rotary knob is set in the door edge where it is visible and accessible when the door is open, but hidden when the door is closed. This knob has a central hole adapted to fit a screwdriver or even a car key. It is connected to the locking lever so that it can be pivoted to throw the latch into the locked position. A door equipped with this latch can be locked manually by opening the door to gain access to the unlocking knob mounted on the door edge, then inserting a key or the like in its slot to pivot it into the locked position. Subsequent closing the door blocks ready access to this unlocking knob.

While such a system does allow one to lock a vehicle door when the central-lock system is not operating, it has several major disadvantages. The door-edge locking knob constitutes one more part in the respective door latch, increasing the cost of this mass-production item. Furthermore the latch becomes more difficult to install with one more element that must be lined up with a hole in the door and then tested. Finally the hole in or around this rotary manual-lock element is an opening through which a tool inserted past the door seal can enter the latch and, in the hands of a skilled thief, unlock the door.

OBJECTS OF THE INVENTION

It is therefore an object of the present invention to provide an improved manually lockable powered door latch for a motor vehicle.

Another object is the provision of such an improved manually lockable powered door latch for a motor vehicle which overcomes the above-given disadvantages, that is, which is of simple construction, which does not require extra care in installation of the latch, and which does not present a security weak point.

A further object is to provide such a latch particularly suitable for use on a door, normally a back door or a hatch or trunk lid, that is provided with a motor or the like normally serving to lock and unlock it.

SUMMARY OF THE INVENTION

A motor-vehicle door latch has as is known a lever displaceable between a locked position in which the latch is locked and an unlocked position in which the latch is unlocked and a plate carrying the latch and adapted to be exposed at a door edge. According to the invention the plate is formed with a throughgoing hole, and the lever has a formation exposed at the hole and engageable through the hole to move the lever from the unlocked to the locked position.

Thus this lever, which is a standard part of the mechanism normally provided in the latch, is provided with the inventive formation so that it can be acted on directly to lock the door. No extra actuating element is needed so that the latch has no more parts than a latch without the manual-lock feature and costs no more to make or install.

In accordance with the invention a toggle spring engaging the lever retains it under spring force in the locked and unlocked positions. Thus both of the end positions—locked and unlocked—are stable.

The plate according to the invention is generally flat around the hole and the lever has a flat part closely juxtaposed at the hole with an inside face of the plate. The flat part has the formation. Moreover, the formation is a ridge projecting from the flat part toward the plate and exposed in the unlocked position through the hole. The flat part has a flat smooth surface adjacent the ridge and exposed through the hole in the locked position. Thus when the door is locked, all that is presented through the hole is the smooth surface of the locking lever so that it is not possible to actuate the locking lever.

In addition the hole has an outer edge closely spacedly juxtaposed with and confronting the ridge in the unlocked position and less closely spaced from and confronting the ridge in the locked position. The hole also has an inner edge aligned with the ridge in the locked position. Thus the latch is manually locked by inserting something like a key blade between the hole outer edge and the ridge and twisting it so as to cam them apart and shift the locking lever into the locked position. The only action that is possible through the hole is thus moving the lever into the locked position. Pivoting it back in the opposite direction, even if that were effective to reset the latch in the unlocked position, is not possible as there is no way to get a meaningful purchase on the flat face of the locking lever, especially to someone working on a closed door past the door seal.

The lever according to the invention pivots about a pivot axis and the edges extend generally radially of the axis. In addition the plate is formed with an outwardly open bolt-receiving notch adjacent the hole.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
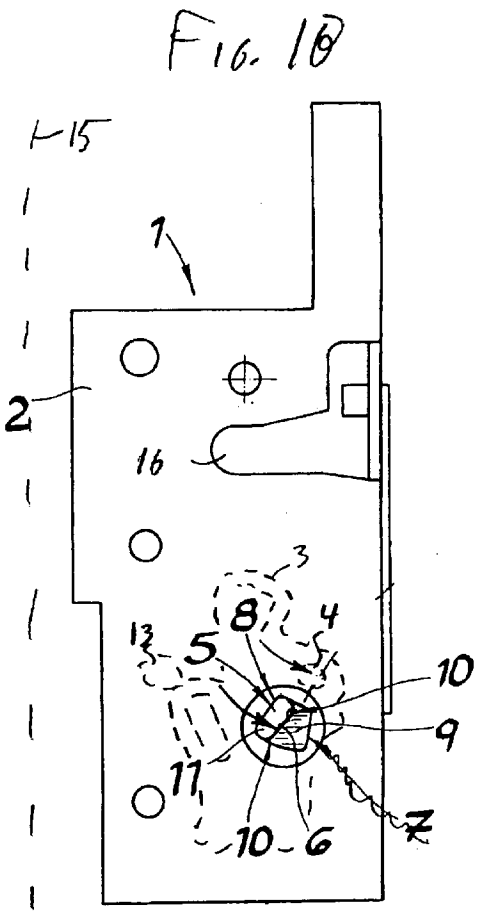
FIGS. 1A and 1B are views locking forward from inside and rearward from outside of a door-edge latch plate carrying the principal elements of the instant invention in the unlocked position.

As seen in FIGS. 1A through 2B, a motor-vehicle door whose inside face is indicated by dashed line 15 in FIG. 1B carries on its rear edge a door latch 1 of which here only a latch fork 17 and locking lever 3 are shown. The latch mechanism is all carried on a plate 2 that is mainly flat and normally oriented vertically and perpendicular to the vehicle travel direction. The locking fork 17 is engageable with an unillustrated bolt extending from an also unillustrated door post and fittable in a notch or mouth 16 of the plate 2 as is standard.

Figure 1A:
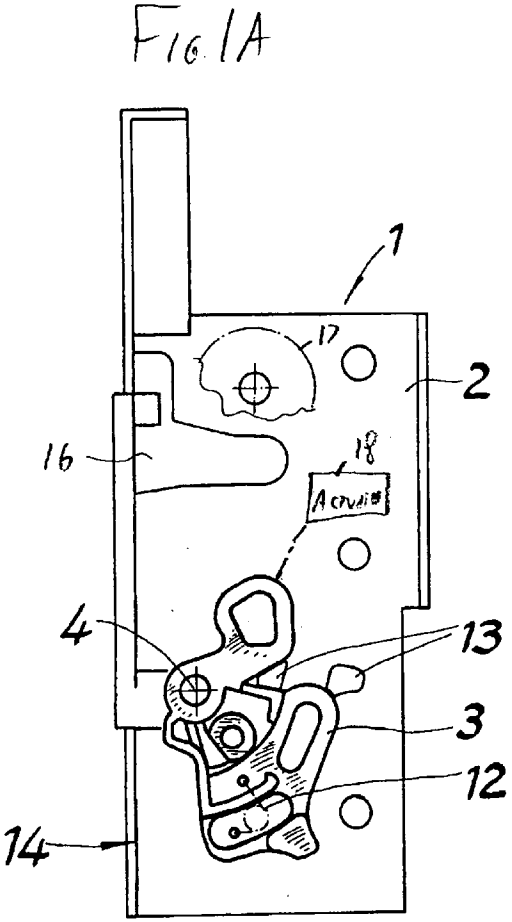
Figure 2B:
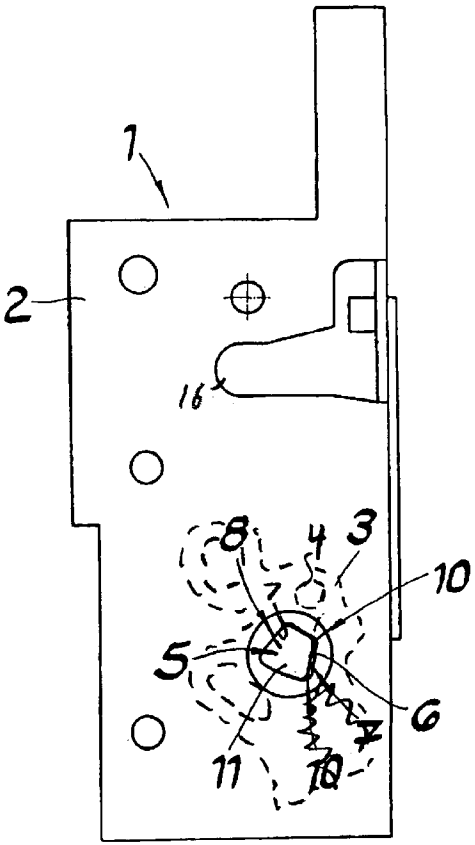
FIGS. 2A and 2B are views like respective FIGS. 1A and 1B of the mechanism in the locked position.
Figure 2A:
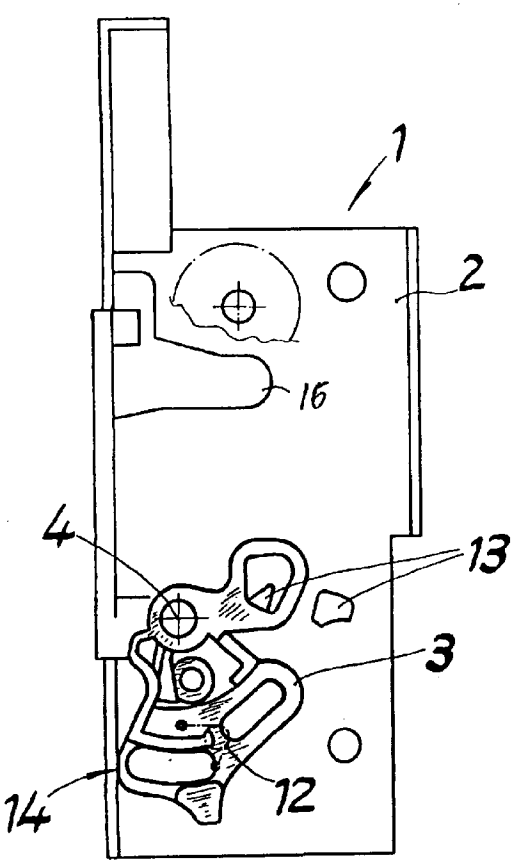

The element or lever 3 serves to lock and unlock the latch. It is pivoted at 4 about a horizontal axis extending in the travel direction below the bolt mouth 16. The unlocked position of the locking lever 3 is shown in FIGS. 1A and 1B and the locked position in FIGS. 2A and 2B. Thus as seen from the rear in FIGS. 1B and 2B, the lever 3 must be pivoted counterclockwise about the pivot 4 to move from the unlocked to the locked position. A toggle spring 12 urges the lever 3 into the unlocked position against abutments 13 on the plate 2 and into the locked position against an abutment surface 14 of the plate 2. This locking lever 3 is a standard part of any door latch, not an extra part added for the invention described below. It is coupled by unillustrated standard mechanism to the lock fork 17, to inside and outside door handles, and to a remote power actuator illustrated schematically at 18 (FIG. 1A).

Figure 3:
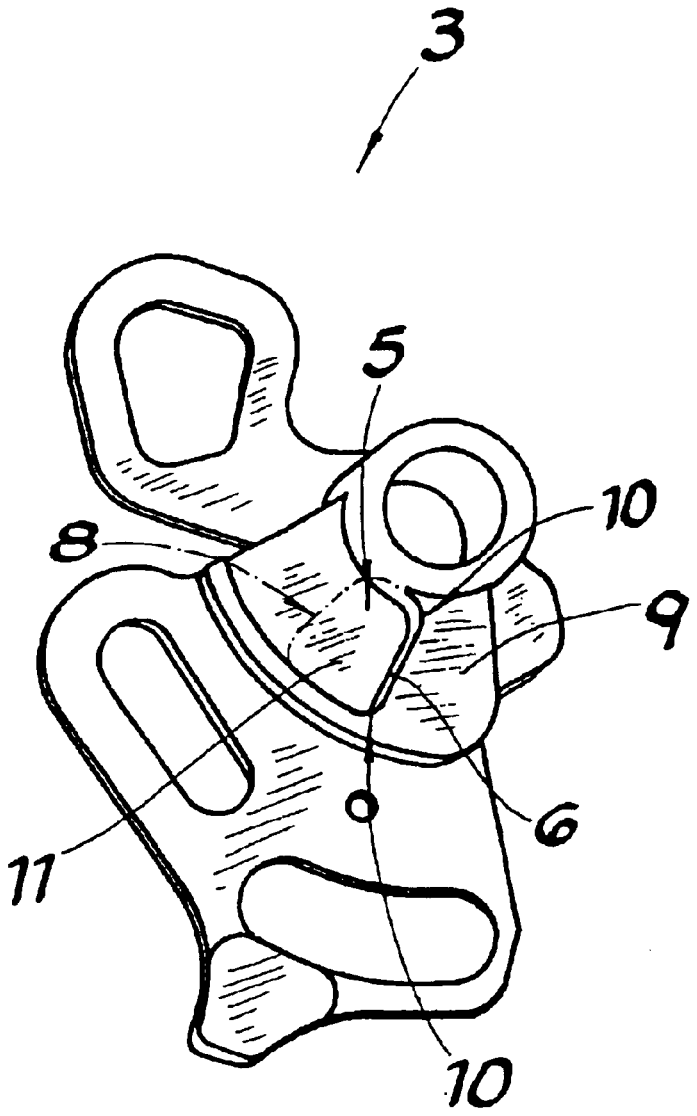
FIG. 3 is a perspective view of the locking lever seen from behind and outside as in FIGS. 1B and 2B.

According to the invention a portion of the plate 2 offset from the pivot 4 and in line with a segment-plate part 9 of the lever 3 (see FIG. 3) is formed with a throughgoing hole or aperture 8 shaped as a segment of a circular annulus and through which this plate part 9 is exposed. The part 9 lies flatly against the inside surface of the mounting plate 1. This aperture 8 has outer and inner edges 7 and 10 both extending generally radially of the pivot 4.

The plate 9 of the lever 3 has a recess 5 formed as an axially and angularly open pocket having an end edge or ridge 6 extending radially of and in a plane including the pivot 4 and a flat floor surface 11 exposed through the aperture 8. In the unlocked position (FIGS. 1A and 13) the edge 6 extends across about the middle of the aperture 8 and at a slight spacing and parallel to the radially extending outside flank 7 of this aperture 8. In addition in this position a email part of the recess 5 and its floor 11 are exposed. In the locked position (FIGS. 2A and 2B) the edge 6 is aligned with the inside flank 10 of the aperture 8 and somewhat more of the smooth floor 11 of the recess 5 is exposed.

Thus if the central-looking system is inoperative so the actuator 18 cannot move the lever 3 into the locked position, all the vehicle operator need do after pulling open the unlocked door is insert the blade of a key or the like into the hole 5 and twist it, camming the edge 6 away from the edge 7 and setting the lever 3 in the locked position. Once in the locked position all that is exposed through the aperture 8 is the flat smooth floor 11 of the lever 3, giving no purchase to pry the lever 3 back into the unlocked position and offering no passage into the latch 1 itself. The lever 3 is provided on the latch 1 in any case and the formations of the recess 5 does not add perceptibly to its construction cost, and punching the extra hole B through which the recess 5 is accessed does not add perceptible to the cost of manufacture of the plate 2 so that the system of this invention represents a modification offering a particularly effective feature at no meaningful extra cost.

I claim:

1. In a motor-vehicle door latch having a lever displaceable between a locked position in which the latch is locked and an unlocked position in which the latch is unlocked and a plate carrying the latch and adapted to be exposed at a door edge, the improvement wherein the plate has an inside face and is formed at the face with a throughgoing hole;

the lever has a flat part closely juxtaposed at the hole with the inside face of the plate and blocking the hole in both the unlocked and locked positions; and the lever has on the flat part a ridge exposed at the hole in the unlocked position through the hole, not projecting into the hole, and engageable by a tool inserted through the hole to move the lever from the unlocked to the locked position.

2. The motor-vehicle door latch defined in claim 1, further comprising a toggle spring engaging the lever and retaining it under spring force in the locked and unlocked positions.

3. The motor-vehicle door latch defined in claim 1 wherein the flat part has a flat smooth surface adjacent the ridge and exposed through the hole in the locked position.

4. The motor-vehicle door latch defined in claim 3 wherein the hole has an outer edge closely spacedly juxtaposed with and confronting the ridge in the unlocked position and less closely spaced from and confronting the ridge in the locked position.

5. The motor-vehicle door latch defined in claim 4 wherein the hole has an inner edge aligned with the ridge in the locked position.

6. The motor-vehicle door latch defined in claim 5 wherein the lever pivots about a pivot axis and the inner and outer edges of the hole extend generally radially of the axis.

7. The motor-vehicle door latch defined in claim 1 wherein the plate is formed with an outwardly open bolt-receiving notch adjacent the hole.

* * * * *